US005728034A

United States Patent [19]

Lamothe

[11] Patent Number: 5,728,034

[45] Date of Patent: Mar. 17, 1998

[54] EXERCISE LEG AND ARM EXTENSION DEVICE

[76] Inventor: Ted A. Lamothe, 5512-45th Ave. South, Minneapolis, Minn. 55417

[21] Appl. No.: 724,356

[22] Filed: Oct. 1, 1996

[51] Int. Cl.[6] ..... A63B 21/00; A63B 71/00

[52] U.S. Cl. ..... 482/131; 482/132; 482/133; 482/139

[58] Field of Search ..... 482/72, 131, 133, 482/907, 91, 92, 51, 139, 132, 122, 123, 125, 126, 129, 130, 114, 115, 120, 70

[56] References Cited

U.S. PATENT DOCUMENTS

| | | | |
|---|---|---|---|
| 3,636,946 | 1/1972 | Hardy | 128/57 |
| 3,966,200 | 6/1976 | Kirk | 272/109 |
| 4,004,801 | 1/1977 | Companaro et al. | 272/120 |
| 4,200,279 | 4/1980 | Lambert, Jr. | 272/118 |
| 4,391,443 | 7/1983 | Beecroft | 272/145 |
| 4,463,945 | 8/1984 | Spector | 272/73 |
| 4,512,571 | 4/1985 | Hermelin | 482/70 |
| 4,647,035 | 3/1987 | Yellen | 482/72 |
| 4,799,667 | 1/1989 | Suchy | 272/36 |
| 4,944,511 | 7/1990 | Francis | 272/137 |
| 5,253,639 | 10/1993 | Johnston | 482/131 |
| 5,645,514 | 7/1997 | Chen | 482/119 X |

FOREIGN PATENT DOCUMENTS

| | | | |
|---|---|---|---|
| 2403089 | 4/1979 | France | 482/72 |
| 265908 | 7/1989 | France | 482/131 |
| 592647 | 2/1934 | Germany | 482/92 |
| 403165 | 12/1933 | United Kingdom | 482/72 |

*Primary Examiner*—Richard J. Apley
*Assistant Examiner*—Denise Pothier
*Attorney, Agent, or Firm*—Michael S. Sherrill

[57] ABSTRACT

An exercise machine having a band connected at a first end to a longitudinally recipricable foot rest and sequentially extending around a first roller located at a first end of the machine, underneath the foot rest, and around a second roller located at a second end of the machine. A pair of handles is attached to the second end of the band.

20 Claims, 3 Drawing Sheets

EXERCISE LEG AND ARM EXTENSION DEVICE

FIELD OF THE INVENTION

The invention relates to exercise machines. More specifically, the invention relates to exercise machines in which the user provides the resistance.

BACKGROUND

Numerous exercise machines have been developed from sophisticated, electronically controlled, hydraulic exercise stations to simple, spring loaded, hand-held equipment. Despite the development of such diverse exercise equipment, the search continues for simple and inexpensive exercise equipment which offers a fresh and exhilarating workout.

SUMMARY OF THE INVENTION

The invention is an inexpensive exercise machine with (i) a seat connected to a first longitudinal end a frame, (ii) a first roller rotatably connected to the frame proximate the first longitudinal end of the frame, (iii) a second roller rotatably connected to the frame proximate the second longitudinal end of the frame, (iv) a foot rest between the first and second rollers for longitudinally reciprocating between the first and second rollers, (v) a band connected at a first end to the foot rest and sequentially extending from the foot rest around the first roller, underneath the foot rest, and around the second roller, with the second end of the band directed back towards the first longitudinal end of the frame and the seat, and (vi) a pair of handles attached to the second end of the band.

The exercise machine optionally includes (vii) a means for vertically supporting the foot rest in an elevated position, and (viii) a means for longitudinally guiding the foot rest as the foot rest is reciprocated between first and second longitudinal positions. An exemplary vertical support means for the foot rest is a wheeled support structure attached to each lateral end of the foot rest. An exemplary guide means for the foot rest is a longitudinally extending guide line in communication with at least one of the wheeled support structures.

The exercise machine is used by simply sitting in the seat, placing both feet upon the foot rest, gripping both handles with the hands, and then pushing the legs and pulling the arms so as to move the foot rest back and forth between the rollers. More specifically, a user longitudinally reciprocates the foot rest and handles by (i) extending the legs while pulling on the band with the arms so as to resist extension of the legs until the foot rest has reached a longitudinal extension position, and then (ii) curling the arms towards the body while pushing on the foot rest with the legs so as to resist curling of the arms until the foot rest has reached a longitudinal contraction position.

DETAILED DESCRIPTION OF THE INVENTION

INCLUDING A BEST MODE

Nomenclature

Figure 1:
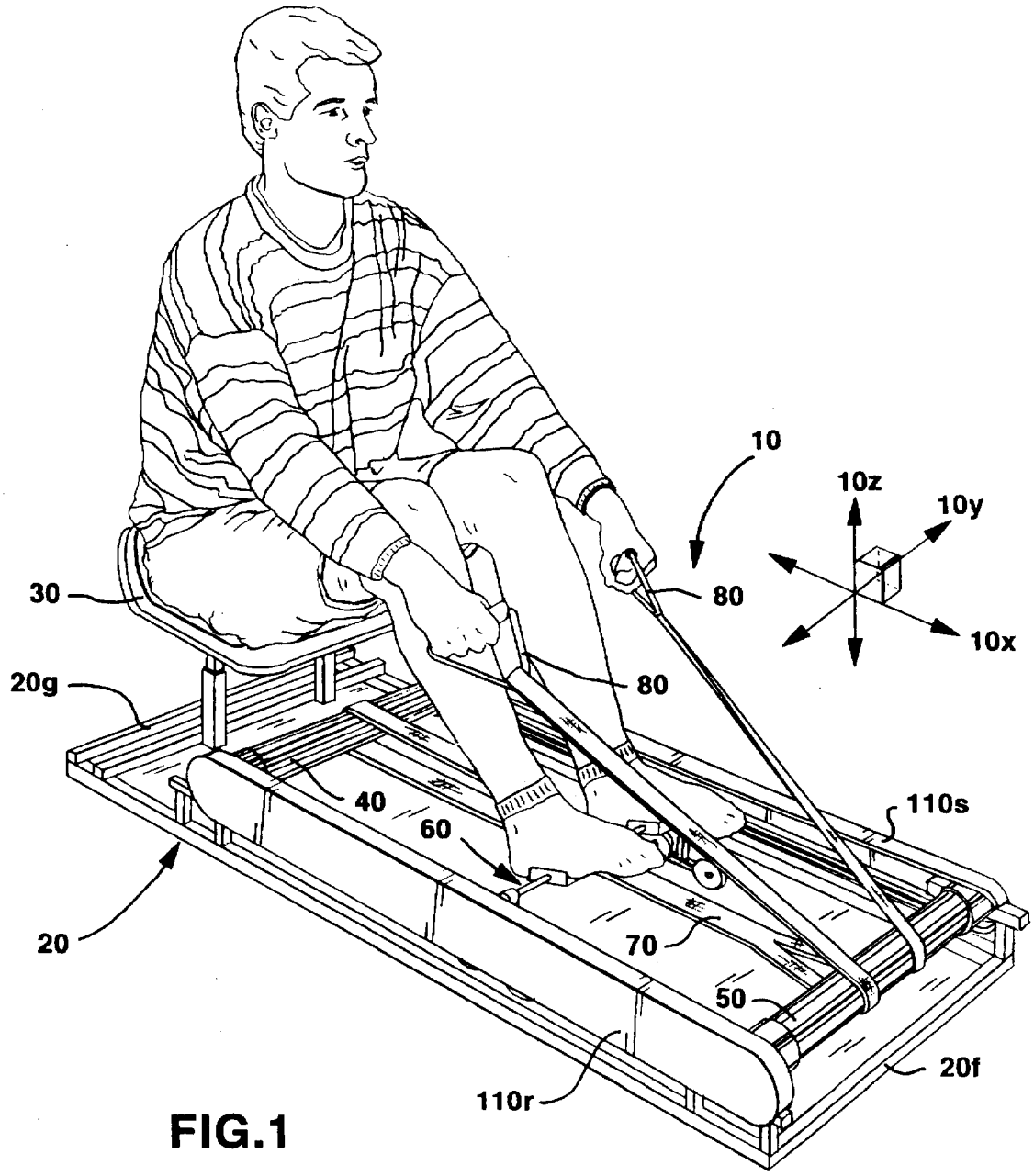
FIG. 1 is a perspective view of one embodiment of the invention in use.
Figure 2:
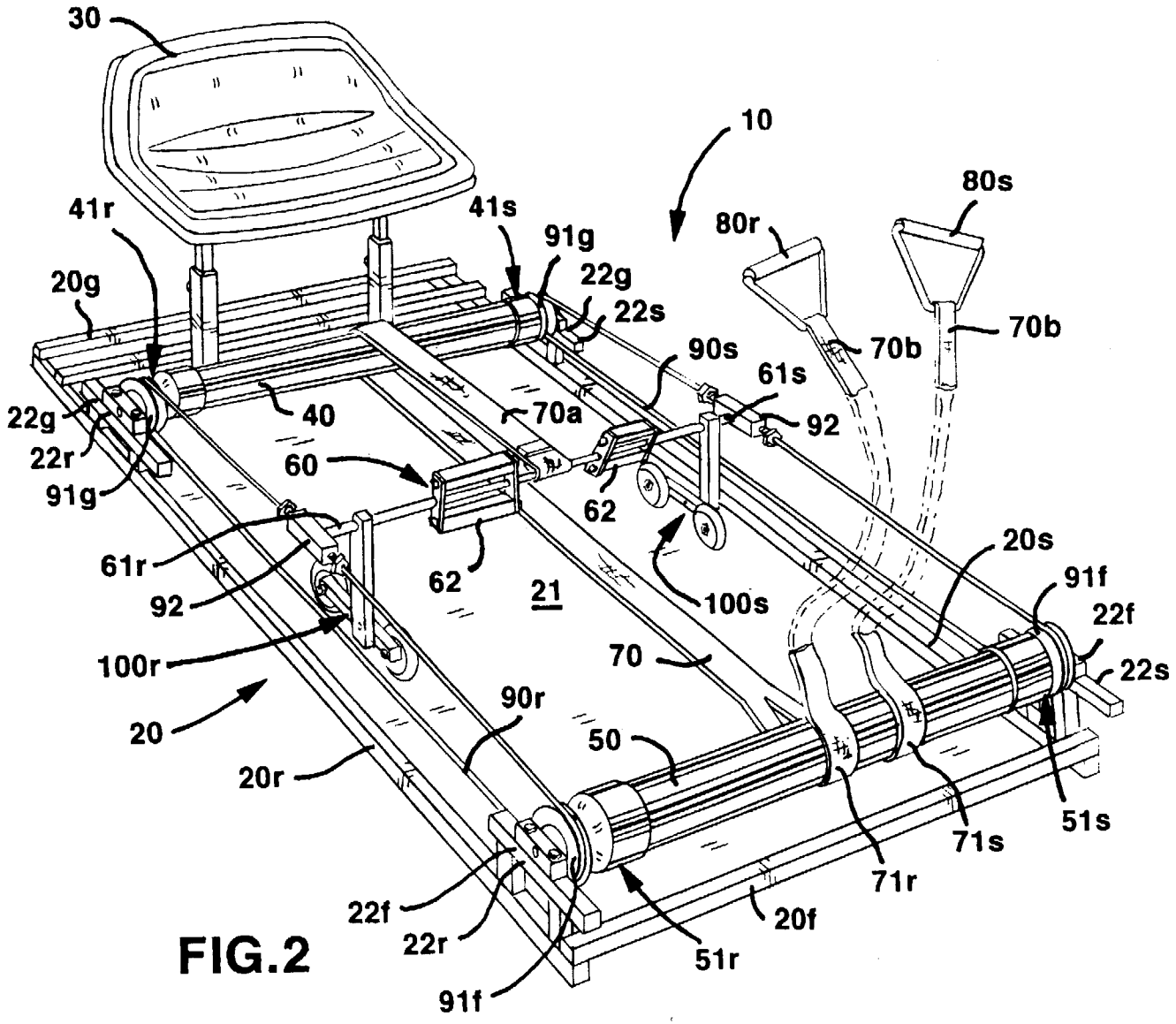
FIG. 2 is a perspective view of the invention shown in FIG. 1 with the side safety shields removed for facilitating viewing of the shielded components.
Figure 3:
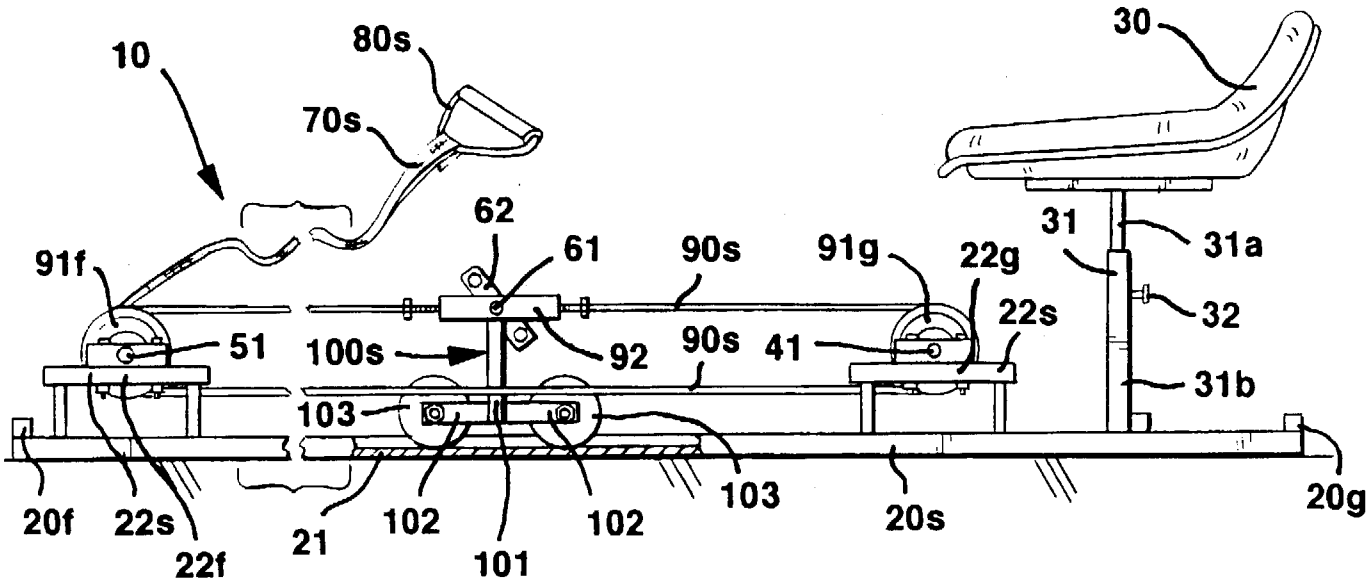
FIG. 3 is a side view of the invention shown in FIG. 2.

10 Exercise Machine
10*x* Direction of Longitude and Frame Length
10*y* Lateral Direction of and Direction of Frame Width
10*z* Direction of Frame Height
20 Frame
20*f* Front of Frame
20*g* Rear of Frame
20*r* Right Side of Frame
20*s* Left Side of Frame
21 Base Plate
22*f* Front Stanchions
20*g* Rear Stanchions
22*r* Right Side Stanchions
22*s* Left Side Stanchions
30 Seat
31 Telescoping Support Posts
31*a* Inner Portion of Telescoping Support Posts
31*b* Outer Portion of Telescoping Support Posts
32 Locking Pin
40 First Roller
41 Axle of First Roller
40*r* Right End of First Roller Axle
41*s* Left End of First Roller Axle
50 Second Roller
51 Axle of Second Roller
51*r* Right End of Second Roller Axle
51*s* Left End of Second Roller Axle
60 Foot Rest Assembly
61 Axle of Foot Rest
61*r* Right End of Foot Rest Axle
61*s* Left End of Foot Rest Axle
62 Foot Pedals
70 Band
70*a* First Longitudinal End of Band
70*b* Second Longitudinal End of Band
71*r* Right Strap
71*s* Left Strap
80 Handles
80*r* Right Side Handle
80*s* Left Side Handle
90*r* Right Side Guide Line
90*s* Left Side Guide Line
91*f* Front Pulleys
91*g* Rear Pulleys
92 Turnbuckle
100*r* Right Side Wheeled Support
100*s* Left Side Wheeled Support
101 Vertical Leg of Support
102 Horizontal Leg of Support
103 Wheels
110*r* Right Side Safety Shield
110*s* Left Side Safety Shield Construction The invention is an inexpensive exercise machine 10 in which the user (unnumbered) provides the resistive force. Referring to FIGS. 1–3, the invention includes (i) a seat 30 connected to the rear end 20*g* of a frame 20, (ii) a first roller 40 positioned proximate the rear end 20*g* of the frame 20, (iii) a second roller 50 positioned proximate the front end 20*f* of the frame 20, (iv) a foot rest 60 positioned intermediate the first 40 and second 50 rollers and moveable between a first longitudinal position proximate the first roller 40 and a second longitudinal position proximate the second roller 50, (v) a band 70 connected at a first end 70a to the foot rest 60 and sequentially extending from the foot rest 60 around the first roller 40, underneath the foot rest 60, and around the second roller 50, with the second end 70*b* of the band 70 directed back towards the rear 20*g* of the frame 20, and (vi) a pair of handles 80 attached to the second end 70*b* of the band 70.

The exercise machine 10 preferably includes various optional equipment, such as (vii) right 90*r* 2nd left 90*s* guide line for longitudinally guiding the foot rest 60 as the foot rest 60 is reciprocated between the first and second longitudinal positions, (viii) right 100*r* and left 100*s* wheeled supports for vertically supporting the foot rest 60 in an elevated position, and (ix) right 110*r* and left 110*s* safety shield covering the various operational elements on the right 20*r* and left 20*s* sides of the machine 10.

Referring to FIGS. 1–3, an adjustable seat 30 is attached to the rear end 20*g* of a frame 20. The embodiment shown in FIGS. 1–3 includes a pair of telescoping posts 31 supporting the seat 30 at the desired vertical height 10*z*.

The outer portion 31*b* of each post 30 includes a single hole (not shown) through which a locking pin 32 is slidably engaged. The inner portion 31*a* of each post 30 includes a series of vertically spaced holes (not shown) configured and arranged to accommodate the locking pin 32. The vertical height 10*z* of the seat can be adjusted by simply removing the locking pins 32, adjusting the height 10*z* of the seat 30 to the desired position, aligning the hole through the outer portion 31*b* of each post 30 with the closest hole through the corresponding inner portion 31*a* of the post 30, and then reinserting the locking pin 32 through both holes.

The seat 30 can also be provided with a means for adjusting the longitudinal position 10*x* of the seat 30 on the frame 20 as is standard in the industry.

The first 40 and second 50 rollers can be substantially any device effective for changing the direction of the band 70 with minimal resistance, including flywheels, pulleys and elongated cylindrical rollers.

Referring to FIGS. 1–3, a first laterally extending roller 40 is attached to the frame 20 proximate the rear end 20*g* of the frame 20. The axle 41 of the first roller 40 is connected to the frame 20 by a pair of rear stanchions 22*g* attached to the right 20*r* and left 20*s* sides of the frame 20. Similarly, a second laterally extending roller 51) is attached to the frame 20 proximate the front end 20*f* of the frame 20, with the axle 51 of the second roller 51) connected to the frame 20 by a pair of front stanchions 22*f* attached to the right 20*r* and left 20*s* sides of the frame 20.

The longitudinal distance 10*x* between the first 40 and second 50 rollers defines the length 10*x* of the exercise area (unnumbered) within which the legs (unnumbered) of a user can be reciprocated. Hence, the first 40 and second 50 rollers should be longitudinally spaced a minimum of 3 feet apart, with the rollers 40 and 50 preferably spaced between about 4 to 6 feet apart. A space of less than about 3 feet may prevent some users from achieving full leg extension on the machine 10, while a space of greater than about 6 feet unnecessarily increases the size and cost of the machine 10.

The diameter (unnumbered) of the first 40 and second 50 rollers is preferably between about 1 and 4 inches most preferably about 2 to 4 inches. A diameter of less than about 1 inch increases wear and tear on both the rollers 40, 50 and band 70 due to the increased speed and acceleration of the rollers 40, 50. A diameter of greater than about 4 inches increases the size and cost of the machine 10 without a corresponding increase in performance.

The lateral length 10*y* of the first 40 and second 50 rollers operable for contacting the band 70 is preferably between about 1 to 3 feet, with a most preferred length of about 2½ to 3 feet.

Referring to FIGS. 1–3, a foot rest assembly 60 is provided between the first 40 and second 50 rollers. The foot rest assembly 60 includes a pair of foot pedals 62 which are rotatable about a laterally extending axle 61 for accommodating changes in the vertical angle of a user's feet (unnumbered) as the user's legs (unnumbered) are extended and contracted.

The right 61*r* and left 61*s* ends of the axle 61 are each connected to the vertical leg 101 of the corresponding right 100*r* and left 100*s* wheeled supports and then to the base (unnumbered) of a turnbuckle 92 attached to the corresponding right 90*r* and left 90*s* guide lines. The wheeled supports 100*r* and 100*s* are only one of several mechanisms effective for supporting the foot rest assembly 60 about 3 to 12 inches above the base plate 21 of the frame 20 for purposes of providing clearance for the band 70 and preventing a user's heels (unnumbered) from dragging on the base plate 21.

Referring to FIGS. 1 and 2, a band 70 interconnects the foot rest assembly 60 and a pair of handles 80 for purposes of permitting a user to provide resistive force during the extension and contraction of the arms and legs. A first longitudinal end 70*a* of the band 70 is looped around the axle 61 of the foot rest assembly 60 between the foot pedals 62 then sequentially extended counterclockwise around the first roller 40, underneath the foot rest 60, and counterclockwise around the second roller 50 as viewed from the right side of the exercise machine 10. The second end 70*b* of the band 70 remains free and is directed by the second roller 50 back towards the seat 30 where handles 80 attached to the second end 70*b* of the band 70 can be gripped by a user seated in the seat 30.

As shown in FIGS. 1 and 2, the second longitudinal end 70*b* of the band 70 can be split into right 71*r* and left 71*s* straps of about 2 to 6 feet in length to which right 80*r* and left 80*s* handles are attached. Of course other mechanisms can be employed to permit proper lateral 10*y* positioning of the handles 80, such as a handle bar with handle grips at each end or a length of rope with handles secured at both ends.

The band 70 can be constructed from substantially any material possessing the necessary flexibility, structural strength and durability. A nonexhaustive list of such materials includes hemp, leather, nylon, natural and synthetic rubbers, etc. The band 70 is preferably constructed from a substantially nonelastic material in order to increase the durability of the band 70 and avoid significant variations in the distance traveled by the arms and legs in any single rep as well as the distance traveled by the arms and/or legs from rep to rep.

The necessary and desired length of the band 70 depends upon the length 10*x* and height 10*z* of the machine 10 as well as the longitudinal distance between the first 40 and second 50 rollers. Generally, a length of between about 10 to 16 feet, in combination with an adjustable catch (not shown) at the first longitudinal end 70*a* of the band 70 effective for increasing or decreasing the size of the loop (unnumbered) around the axle 61 of the foot rest assembly 60, permits users to adjust the length of the band 70 as necessary to sit comfortably in the seat 30 with proper positioning of both arms and legs during exercising.

The surface (unnumbered) of the first 40 and second 50 rollers is preferably smooth for decreasing wear and tear on the band 70 and thereby increasing the service life of the band 70. Alternatively, the surface of the first 40 and second 50 rollers can be textured (e.g., knurled or laterally channeled) for purposes of ensuring that rotation of the first 40 and second 50 rollers is synchronized and/or reducing lateral 10y wandering of the band 70 across the surface of the rollers 40, 50.

Referring to FIGS. 2 and 3, longitudinal reciprocation of the foot rest 60 is guided by right 90*r* and left 90*s* guide lines. The right 90*r* and left 90*s* guide lines independently extend around a front 91*f* and a rear 91*g* pulley, with the terminal ends (unnumbered) of the right 90*r* and left 90*s* guide lines independently connected to a turnbuckle 92. The front pulleys 91*f* are mounted onto the right 51*r* and left 51*s* ends of the axle 51 for the second roller 50. Similarly, the rear pulleys 91*g* are mounted onto the right 41*r* and left 41*s* ends of the axle 41 for the first roller 40.

The right 61*r* and left 61*s* ends of the axle 61 for the foot rest 60 are attached to the base (unnumbered) of the turnbuckles 92 which are connected to the right 90*r* and left 90*s* guide lines respectively.

Referring to FIGS. 2 and 3, the right 61*r* and left 61*s* ends of the axle 61 for the foot rest 60 are each connected to the vertical leg 101 of a corresponding right 100*r* and left 100*s* wheeled support. The vertical leg 101 of each wheeled support 100*r* and 100*s* is attached to a horizontal leg 102 upon which are mounted a pair of wheels 103. The wheels 103 travel upon the base plate 21 of the frame 20 as the foot rest 60 is reciprocated between the first and second longitudinal positions.

As mentioned previously, the wheeled supports 100 preferably position the foot rest 60 about 3 to 12 inches above the base plate 21 of the frame 20 for purposes of providing clearance for the band 70 under the foot rest 60 and preventing a user's heels (unnumbered) from dragging on the base plate 21.

Referring to FIG. 1, the exercise machine 10 preferably includes right 110*r* and left 110*s* safety shields mounted upon the right 22*r* and left 22*s* stanchions respectively. The right 110*r* and left 110*s* safety shields protectively cover the corresponding right 90*r* and left 90*s* guide lines and corresponding pulley 91.

The exercise machine 10 is used by simply sitting in the seat 30, placing both feet upon the foot rest 60, gripping both handles 80, and then simultaneously pushing the legs and pulling the arms so as to move the foot rest 60 back and forth between the rollers 40 and 50.

More specifically, a user longitudinally reciprocates the foot rest 60 and handles 80 by (i) extending the legs while pulling on the handles 80 with the arms so as to resist extension of the legs until the foot rest 60 has reached a longitudinal extension position, and then (ii) curling the arms towards the body while pushing on the foot rest 60 with the legs so as to resist curling of the arms until the foot rest 60 has reached a longitudinal contraction position.

I claim:

1. An exercise machine comprising:

(a) a frame having first and second longitudinal ends;

(b) a seat connected to the frame proximate the first longitudinal end of the frame;

(c) a first roller rotatably connected to the frame proximate the first longitudinal end of the frame;

(d) a second roller rotatably connected to the frame proximate the second longitudinal end of the frame;

(e) a foot rest operably positioned between the first and second rollers for longitudinally reciprocating within an exercise area defined by the first and second rollers between a first longitudinal position proximate the first roller and a second longitudinal position proximate the second roller, and in communication with the frame for guiding longitudinal movement of the foot rest;

(f) a band connected at a first end to the foot rest and sequentially extending from the foot rest (i) around the first roller, (ii) underneath the foot rest, and (iii) around the second roller, wherein a second end of the band is positioned and arranged for extension into the exercise area; and (g) a pair of handles attached to the second end of the band.

2. The exercise machine of claim 1 further comprising at least one synchronization belt in communication with the first and second rollers and the foot rest for synchronizing rotation of the first and second rollers and longitudinal movement of the foot rest.

3. The exercise machine of claim 1 further comprising a means for vertically supporting the foot rest in an elevated position.

4. The exercise machine of claim 1 wherein the foot rest is indirectly connected to the frame through a means for longitudinally guiding the foot rest as the foot rest is reciprocated between the first and second longitudinal positions.

5. The exercise machine of claim 4 wherein the first and second rollers have independent lateral lengths of between about 1 to 3 feet and a diameter of about 2 to 4 inches.

6. The exercise machine of claim 4 wherein the longitudinal distance between the first and second rollers is approximately 3 to 6 feet.

7. The exercise machine in claim 1 further comprising (i) a wheeled support structure attached to each lateral end of the foot rest for vertically supporting the foot rest in an elevated position, and (ii) a first longitudinally extending guide line in communication with at least one of the wheeled support structure for guiding longitudinal movement of the support structure.

8. The exercise machine of claim 7 further comprising a second longitudinally extending guide line in communication with the other wheeled support structure for guiding longitudinal movement of the support structure.

9. The exercise machine of claim 8 wherein the first and second guide lines each form a continuous loop engaging a first pulley proximate the first longitudinal end and a second pulley proximate the second longitudinal end.

10. The exercise machine of claim 9 wherein (i) the first roller is rotatable about a first lateral axis, (ii) the second roller is rotatable about a second lateral axis, (iii) the first pulley is rotatable about the first lateral axis, and (iv) the second pulley is rotatable about the second lateral axis.

11. The exercise machine of claim 1 further comprising (i) a means for longitudinally adjusting the position of the seat relative to the frame, and (ii) a means for vertically adjusting the position of the seat relative to the frame.

12. The exercise machine of claim 1 wherein the first and second rollers are laterally extending cylindrical rollers.

13. The exercise machine of claim 12 wherein the surface of each roller is smooth so as to reduce abrasion of the band on the roller.

14. The exercise machine of claim 1 wherein the foot rest includes a pair of foot pedals rotatable about a lateral axis.

15. The exercise machine of claim 1 wherein the band is a substantially nonelastic band.

16. The exercise machine of claim 1 wherein the second longitudinal end of the band is split into a right side length of material and a left side length of material with one of the handles attached to each of the lengths of material.

17. The exercise machine of claim 16 wherein the right and left side lengths of material have identical lengths of about 2 to 6 feet.

18. An exercise machine comprising:

(a) a frame having first and second longitudinal ends;

(b) a seat connected to the frame proximate the first longitudinal end of the frame;

(c) a first laterally extending, smooth surfaced, cylindrical roller rotatably connected to the frame proximate the first longitudinal end of the frame;

(d) a second laterally extending, smooth surfaced, cylindrical roller rotatably connected to the frame proximate the second longitudinal end of the frame;

(e) a pair of foot pedals rotatable about a lateral axis and operably positioned between the first and second rollers for longitudinally reciprocating within an exercise area defined by the first and second rollers between a first longitudinal position proximate the first roller and a second longitudinal position proximate the second roller;

(f) a means for vertically supporting the foot pedals in an elevated position;

(g) a means in communication with the foot pedals and the frame for longitudinally guiding the foot pedals relative to the frame as the foot rest is reciprocated between the first and second longitudinal positions;

(h) a nonelastic band connected at a first end to the foot rest and sequentially extending from the foot pedals (i) around the first roller, (ii) underneath the foot pedals, and (iii) around the second roller; wherein a second end of the band is split so as to form a right side length of material and a left side length of material and the lengths of material are positioned and arranged for extension into the exercise area; and (i) a handle attached to a free end of each of the right side and left side lengths of material at the second end of the band.

19. A method of exercising, comprising:

(a) obtaining an exercise machine which includes at least:

(1) a frame having first and second longitudinal ends;

(2) a seat connected to the frame proximate the first longitudinal end of the frame;

(3) a first roller rotatably connected to the frame proximate the first longitudinal end of the frame;

(4) a second roller rotatably connected to the frame proximate the second longitudinal end of the frame;

(5) a foot rest operably positioned between the first and second rollers for longitudinally reciprocating within an exercise area defined by the first and second rollers between a first longitudinal position proximate the first roller and a second longitudinal position proximate the second roller, and in communication with the frame for guiding longitudinal movement of the foot rest;

(6) a band connected at a first end to the foot rest and sequentially extending from the foot rest (i) around the first roller, (ii) underneath the foot rest, and (iii) around the second roller, wherein a second end of the band is positioned and arranged for extension into the exercise area; and (7) a pair of handles attached to the second end of the band;

(b) sitting in the seat;

(c) placing both feet upon the foot rest;

(d) gripping both handles with the hands; and (e) longitudinally reciprocating the foot rest and handles by (i) extending the legs while pulling on the band with the arms so as to resist extension of the legs until the foot rest has reached a longitudinal extension position, and (ii) curling the arms towards the body while pushing on the foot rest with the legs so as to resist curling of the arms until the foot rest has reached a longitudinal contraction position.

20. A method of exercising, comprising:

(a) obtaining an exercise machine including at least;

(1) a frame having first and second longitudinal ends;

(2) a seat connected to the frame proximate the first longitudinal end of the frame;

(3) a first laterally extending, smooth surfaced, cylindrical roller rotatably connected to the frame proximate the first longitudinal end of the frame;

(4) a second laterally extending, smooth surfaced, cylindrical roller rotatably connected to the frame proximate the second longitudinal end of the frame;

(5) a pair of foot pedals rotatable about a lateral axis and operably positioned between the first and second rollers for longitudinally reciprocating within an exercise area defined by the first and second rollers between a first longitudinal position proximate the first roller and a second longitudinal position proximate the second roller;

(6) a means for vertically supporting the foot pedals in an elevated position;

(7) a means in communication with the foot pedals and the frame for longitudinally guiding the foot pedals relative to the frame as the foot rest is reciprocated between the first and second longitudinal positions;

(8) a nonelastic band connected at a first end to the foot rest and sequentially extending from the foot pedals (i) around the first roller, (ii) underneath the foot pedals, and (iii) around the second roller; wherein a second end of the band is split so as to form a right side length of material and a left side length of material and the lengths of material are positioned and arranged for extension into the exercise area; and (9) a handle attached to a free end of each of the right side and left side lengths of material at the second end of the band;

(b) sitting in the seat;

(c) placing both feet upon the foot pedals;

(d) gripping both handles with the hands; and (e) longitudinally reciprocating the foot pedals and handles by (i) extending the legs while pulling on the band with the arms so as to resist extension of the legs until the foot pedals have reached a longitudinal extension position, and (ii) curling the arms towards the body while pushing on the foot pedals with the legs so as to resist curling of the arms until the foot pedals have reached a longitudinal contraction position.

* * * * *

UNITED STATES PATENT AND TRADEMARK OFFICE

CERTIFICATE OF CORRECTION

PATENT NO. : 5,728,034

DATED : March 17, 1998

INVENTOR(S) : Ted A. Lamothe

It is certified that error appears in the above-identified patent and that said Letters Patent is hereby corrected as shown below:

On the title page, item [54] and column 1 line 1:

Title, delete "Exercise"
Col. 3, line 45, replace "roller 51)" with -- roller 50 --
Col. 3, line 47, replace "roller 51)" with -- roller 50 --
Col. 5, line 29, replace "wheeled supports 100" with "right 100r and left 100s wheeled supports --
Col. 5, line 40, insert the heading "Use"

Signed and Sealed this

First Day of September, 1998

*Attest:*

Bruce Lehman

BRUCE LEHMAN

*Attesting Officer*

*Commissioner of Patents and Trademarks*